US005356022A

United States Patent [19]

Tipps

[11] Patent Number: 5,356,022

[45] Date of Patent: Oct. 18, 1994

[54] CONTAINER FOR TOXIC WASTE

[76] Inventor: Steven V. Tipps, 9224 Highedge Cir., Dallas, Tex. 75238

[21] Appl. No.: 52,196

[22] Filed: Apr. 22, 1993

[30] Foreign Application Priority Data

Apr. 24, 1992 [CH] Switzerland ..... 01326/92-1

[51] Int. Cl.[5] ..... B65D 5/10; B65D 5/60

[52] U.S. Cl. ..... 220/404; 206/366; 220/410; 220/462; 220/908; 229/131.1; 229/907

[58] Field of Search ..... 220/403, 404, 408, 410, 220/462, 463, 908; 229/131.1, 907; 206/366

[56] References Cited

U.S. PATENT DOCUMENTS

| | | | |
|---|---|---|---|
| 2,352,503 | 6/1944 | Walton | 220/403 |
| 3,576,290 | 4/1971 | Marchisen | 220/462 |
| 4,534,489 | 8/1985 | Bartlett | 220/462 |
| 4,638,912 | 1/1987 | Graf | 220/403 |
| 4,674,676 | 6/1987 | Sandel et al. | 229/907 |
| 4,715,511 | 12/1987 | Bohlen | 220/403 |
| 4,863,052 | 9/1989 | Lambert | 229/907 |
| 4,872,588 | 10/1989 | Texidor | 220/403 |
| 4,905,898 | 3/1990 | Wade | 220/403 |
| 5,050,775 | 9/1991 | Marguardt | 220/403 |
| 5,096,114 | 3/1992 | Higginbotham | 229/907 |

FOREIGN PATENT DOCUMENTS

| | | | |
|---|---|---|---|
| 4108254 | 9/1992 | Fed. Rep. of Germany | 220/403 |
| 2660623 | 10/1991 | France | 229/907 |

*Primary Examiner*—Gary E. Elkins
*Attorney, Agent, or Firm*—Gunn & Kuffner

[57] ABSTRACT

This waste container consists of a carton. An internal wrapping is designed to contain the waste and its upper part is held in an opening provided in the one of the upper flaps which is folded down first. At least one of the upper flaps is fitted, at its ends, with a closing and supporting tab designed to operate together with the opposite side of the container. Once filled, internal wrapping is closed by a tie and all upper flaps are folded down. The upper flap which is folded down last is fitted with a tab able to be inserted between flaps already folded down and the opposite side of the carton. This tab is fitted with a slot able to accommodate a safety locking tab which is pulled out of the opposite side of the container.

9 Claims, 2 Drawing Sheets

CONTAINER FOR TOXIC WASTE

FIELD OF THE INVENTION

This invention relates generally to the field of waste containers, and in particular to folding cartons.

BACKGROUND OF THE INVENTION

In order to minimize any contact between toxic waste and the person(s) having to handle these, it has already been proposed to place such waste in a plastic bag, the bag being then placed into a carton which, once closed, provides risk-free handling of the whole.

The purpose of the present invention is to improve this type of product and pertains to a waste container constituted by a carton, of generally parallelepipedal shape, whose lateral sides comprise, at bottom, flaps along lower folding lines and, at top, flaps along upper folding lines, and an internal wrapping.

SUMMARY OF THE INVENTION

The container of the present invention is characterized as follows:

- at least one of the upper flaps is fitted with an opening for insertion of the waste into the internal wrapping,
- at least one of the upper flaps is fitted with means for fastening the top of the wrapping in the opening,
- at least one of the upper flaps is fitted, at its end, with a closing and supporting tab designed to operate together with the opposite side of the container.

In a preferred implementation, all upper flaps of the carton extend up to the side of the carton opposite them and are fitted with means of attachment to it. Moreover, a locking device enables blocking the flaps in place when the container is full and is to be handled.

BRIEF DESCRIPTION OF THE DRAWINGS

Referring now to the drawings in which like reference numerals and letters indicate corresponding elements throughout the several views.

DETAILED DESCRIPTION OF THE PREFERRED EMBODIMENT

Figure 1:
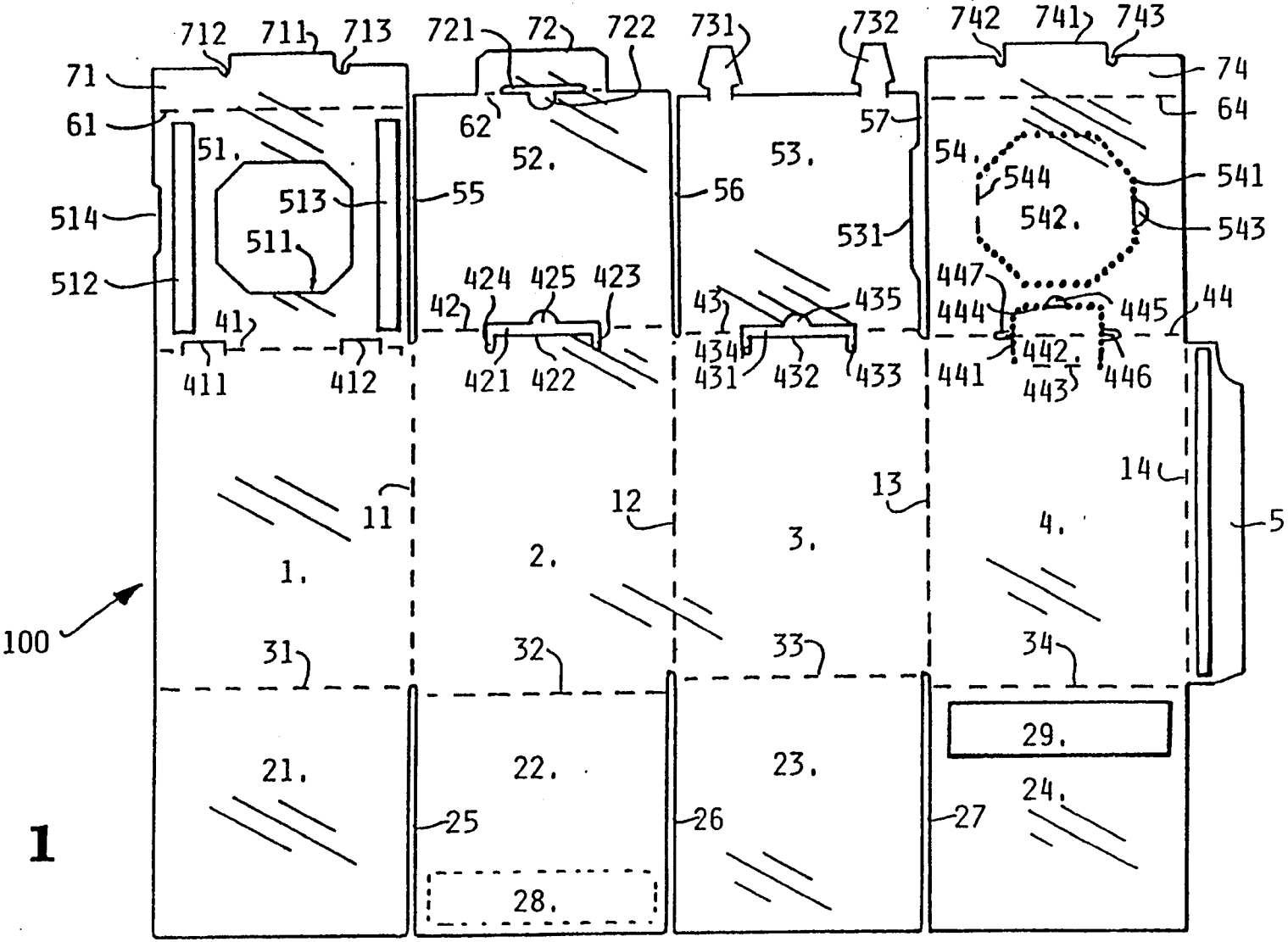
FIG. 1 is a plan view of the cutout of the carton of the present invention.

Cut-out 100, shown in plan view in FIG. 1, is designed for obtention of a tubular carton with a markedly square cross-sectional shape. It thus comprises four sides, 1 to 4, and a lateral closing strip 5, separated from one another by vertical folding lines 11 to 14, shown by dotted-dashed lines, which constitute edges between faces 1 to 4. At bottom, sides 1 to 4 end in four bottom flaps 21 to 24, separated from one another by slots 25 to 27 and situated beyond horizontal folding lines 31 to 34.

One notes that bottom flaps 21 to 24 are of a generally square shape, which enables superimposing them once the carton is assembled, so as to further enhance the strength of the base. The drawing shows schematically self-adhesive strips 28 and 29 on the reverse side of flap 22 and on the upper side of flap 24, which enable assembly of the carton as will be seen hereafter. Horizontal folding lines 41 to 44, shown by dotted-dashed lines on the drawing, are provided at the top of sides 1 to 4 and constitute the edges between the sides and the top of the container. One notes that folding lines 31 to 34 and 41 to 44 are not situated along a same line since the drawing shows with exaggeration the need for a difference between folding heights so as to correct for the thickness of the flaps folded down previously.

Specific cut-outs are provided along folding lines 41 and 44 and shall be described in detail hereafter.

Two cut-outs 411 and 412 are provided along fold 41 in order to constitute slots in this edge once flap 51 has been folded along folding line 41.

Horizontal slots 421 and 431 are provided along folds 42 and 43. Each slot 421 (resp. 431) defines an edge 422 (resp. 432) at the center of side 2 (resp. 3) of the carton. Each slot is extended downwards, at its ends, by two rounded relief holes 423 and 424 (resp. 433 and 434). In its central part, each slot opens onto a half-circular cut-out 425 (resp. 435). The purpose of these details shall be indicated in the description of the carton closing process.

In fold 44, one observes a pre-perforated line 441 which defines a tab 442 which can be pulled out and folded parallel to fold 44 along a line 443. At the end 444 of tab 442, a half-circular cut-out 445 allows for easier pullout of the tab. Two slots 446 and 447 are provided along folding line 44, either side of tab 442.

These folding lines 41 to 44 enable constituting upper flaps 51 to 54, separated from one another by slots 55 to 57.

In the variant shown in the drawing, the specific cut-out of upper flaps 51 to 54 is designed so as to constitute:

1. during the waste insertion phase, an efficient means for fastening a plastic wrapping designed to contain the waste, and
2. to effect secure closing of the container once it has been filled and is about to be transferred.

Flap 51 is fitted with a central opening 511 of generally octagonal shape. The two free sides of flap 51 are fitted with adhesive strips 512 and 513, covered with protective film as long as not used to hold the top of the plastic bag while it is being filled. A lateral relief 514 is provided for reasons which shall be detailed hereafter. In addition, flap 51 if fitted with a closing and supporting tab 71, situated beyond a folding line 61 parallel to lines 31 and 41 mentioned above.

This tab 71 comprises a central part 711 which protrudes between two rounded cut-outs 712 and 713 the purpose of which shall be described hereafter.

Flap 52 is solid. It is fitted, at top, with a central closing tab 72 the width of which is smaller than the spacing between slots 446 and 447 already described above. A slot 721, designed to accomodate tab 442 which can be pulled out of side 4, is provided at the center of tab 72, at the level of a fold 62. A half-circular opening 722 opens in flap 52.

Flap 53 is solid and is fitted with a lateral relief 531 for reasons which shall be detailed hereafter. Flap 53 ends, on its outer side, in two tabs 731 and 732 sized so as to be pushed-in and jam inside slots 411 and 412, mentioned above, along fold 41. One notes the trapezoidal shape of these tabs, designed to hold them jammed into slots 411 and 412.

Flap 54 is fitted with pre-perforations 541 which allow releasing a clapper 542. A half-circular opening 543 enables easier pullout, by the user, of clapper 542 which can be hinged along folding line 544. Flap 54 is also fitted with a closing and supporting tab 74, situated beyond folding line 64 which is parallel to lines 34 and 44, mentioned above. This tab 74 includes a central part 741 which protrudes between two rounded cut-outs 742 and 742 the purpose of which shall be described hereafter.

The carton according to the invention is erected by attaching sides 1 and 4 to one another, by means of lateral strip 5, using a known method such as bonding or stapling. It must be noted that it is then possible to store the cartons folded in two, either along folding lines 11 to 14 or along lines going through sides 1 and 3 or 2 and 4.

Before use, the container is folded out and bottom flaps 23, 21, 24 and 22 are folded down successively along lines 31 to 34. Flap 24 is attached to flap 22 by means of self-adhesive strips 28 and 29.

Figure 3:
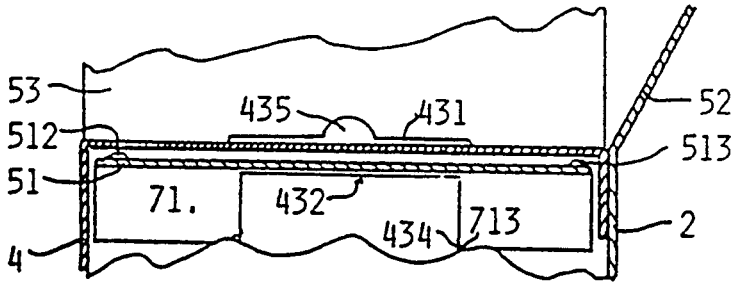
FIG. 3 is a part cutview of the carton, along line III—III of FIG. 2.

The stages of preparation of the upper part of the container are as follows: Flap 51 is folded outwards first, together with tab 71. In the cutview of FIG. 3, one notes that central part 711 of tab 71 is inserted into slot 431 so that flap 51 rests onto support edge 432 situated at top of side 3 of the carton, rounded cut-outs 712 and 713 coming respectively against reliefs 433 and 434.

A plastic bag 200 is then placed inside the container. Its upper part goes through central opening 511 and is attached to flap 51 by means of adhesive strips 512 and 513. Flap 54 is then closed, tab 74 being held against support edge 422 as already seen for tab 71 against support edge 432. Reliefs 423 and 424 also support flap 54, precisely its rounded cut-outs 742 and 743. This supporting system produces a sturdy carton, the upper part of which remains perfectly horizontal and does not risk collapsing downwards. To ensure stiffness of the upper side of the carton, it is advisable to provide support edges 422 and 433 along two adjacent sides, to ensure cross-over of the load-bearing flaps.

Figure 2:
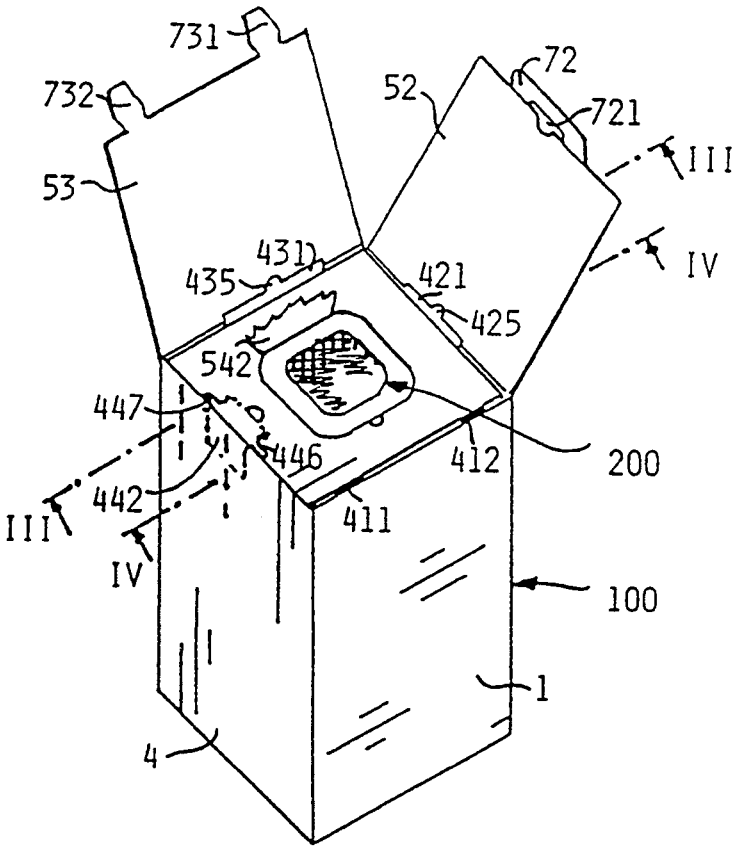
FIG. 2 is a perspective view of the carton as it appears during insertion of waste.

It is preferable that internal wrapping 200 remain visible, as shown in FIG. 2, owing to the increasing dimensions of opening 511 and of clapper 542, since this enables, firstly, to ascertain the presence of the plastic bag and, secondly, to have this bag held betwen flaps 51 and 54.

The user may then tear out clapper 542 along perforated line 541 and fold it rearwards as shown in FIG. 2 which shows the position in which waste is inserted. Clapper 542, shown in part in this drawing, enables keeping the container closed while it is being filled.

Figure 4:
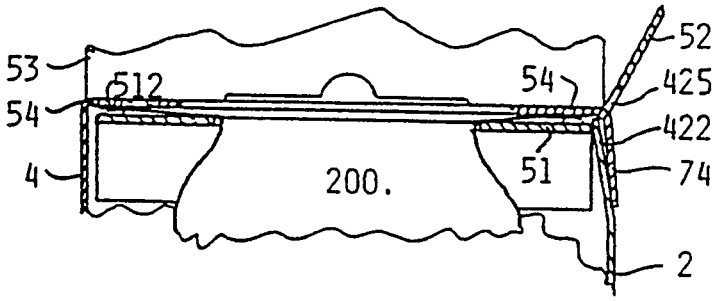
FIG. 4 is a part cutview of the carton, along line IV—IV of FIG. 2; and, FIG. 5 is a cross-section which corresponds to the view of FIG. 4, the carton being in closed position, once all the waste has been placed inside the protective internal wrapping.

As mentioned above, the view if FIG. 3 shows the supporting system of flap 51 against edge 432. FIG. 4 shows how the top of bag 200 goes through flap 51 before being attached along adhesive strips 512 and 513. It also shows the thrusting of tab 74 against edge 422.

Figure 5:
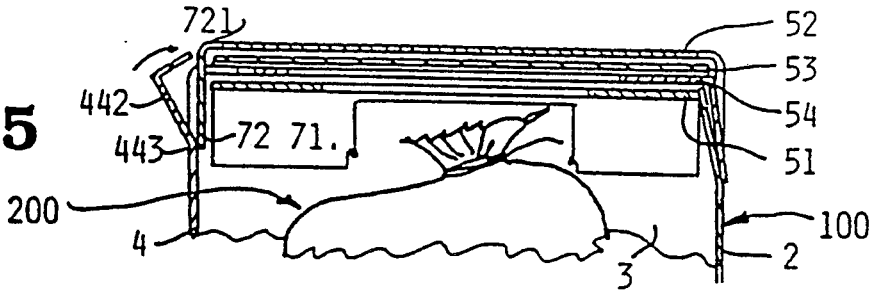

Care shall be taken in not excessively filling the internal wrapping so as to enable closing plastic bag 200 by means of a tie, as shown in FIG. 5, after temporary reopening of flap 54. It must be noted that flaps 52 and 53 are fitted with rounded openings 425 and 435 to facilitate access to central tabs 711 and 741.

Plastic bag 200 being closed by a tie, flap 54 is folded down as described previously, after having torn out safety tab 442 along perforations 441 and having folded it outwards along folding line 443.

Flap 53 is then folded down and trapezoidal tabs 731 and 732 are pushed-in into slots 411 and 412.

Finally, flap 52 is folded down and central tab 72 is inserted into the space freed by withdrawal of tab 442 between slots 446 and 447. Tab 72 is inserted between side 4 of the carton and upper flaps 51 and 53, precisely their upper reliefs 514 and 531.

In order to prevent untimely opening of the flaps during handling operations of the container according to this invention, safety tab 442 is finally inserted into slot 721, as shown in FIG. 5. This tab blocks flaps 51 to 54 since it is inserted into slot 721 of tab 52 and is thus situated above the remaining flaps. Half-circular opening 722 enables withdrawing tab 442 should this be required.

In FIGS. 2 to 4, flaps 52 and 53 are drawn raised up in order to better show their location. Obviously, these flaps can also be placed alongside sides 2 and 3 of the carton which may be fitted with means for attaching these flaps, such as adhesive strips.

I claim

1. A waste container comprising:

a. a carton shaped generally as a parallelepiped having opposing lateral sides and a top, each lateral side comprising a bottom part with a bottom folding line having a flap along the bottom folding line and an upper part with an upper folding line having a flap along the upper folding line; and b. an internal wrapping within the carton, the wrapping having a top, wherein at least one of the upper flaps includes an opening for insertion of waste into the internal wrapping, at least one of the upper flaps includes adhesive strips around the opening for attaching the top of the wrapping inside the opening, and at least one of the upper flaps includes an end with a closing and supporting tab that cooperates with the opposite side of the container.

2. The container of claim 1 wherein the upper flaps are extendible to the opposite side of the container.

3. The container of claim 1 wherein a side of the container accommodates the closing and supporting tab with a slot which defines a support edge designed to cooperate with said closing and supporting tab.

4. The container of claim 3 wherein upper flaps of two adjacent sides include closing and supporting tabs.

5. The container of claim 1 wherein a flap folded over the opening includes a tear-out clapper which forms the opening.

6. The container of claim 1 wherein at least one of the flaps folded over the top of the carton has no cutout.

7. The container of claim 2, wherein one of the flaps along the upper folding line includes tabs at said end for insertion into slots provided along the opposite folding line.

8. The container of claim 2 wherein flaps are folded over the top of the carton seriatim and the upper flap which is the last one to be folded includes a tab for inserting between flaps already folded down and the opposite side of the carton.

9. The container of claim 8 wherein a slot is provided along the folding line of a tab and accommodates a safety locking tab which is pulled out of the top part of the opposite side and the upper flap on the opposite side.

* * * * *